US006557209B1

(12) United States Patent
Wood et al.

(10) Patent No.: US 6,557,209 B1
(45) Date of Patent: May 6, 2003

(54) DEVICE FOR RESTRAINING MOVEMENT OF A DOOR

(75) Inventors: Ronald Frederick Wood, Ballajura (AU); Stephen Grant McMillan, Ballajura (AU)

(73) Assignees: Peter Brian Daykin (AU); Lorraine Adamek (AU)

( * ) Notice: Subject to any disclaimer, the term of this patent is extended or adjusted under 35 U.S.C. 154(b) by 0 days.

(21) Appl. No.: 09/403,140

(22) PCT Filed: Apr. 9, 1998

(86) PCT No.: PCT/AU98/00240

§ 371 (c)(1),
(2), (4) Date: May 24, 2000

(87) PCT Pub. No.: WO98/46847

PCT Pub. Date: Oct. 22, 1998

(51) Int. Cl.[7] ..... E05C 17/50

(52) U.S. Cl. ..... 16/82; 16/86 B; 16/DIG. 17; 292/164; 292/DIG. 15

(58) Field of Search ..... 16/82, 86 B, 86 C, 16/86 R, 85, DIG. 17; 292/164, DIG. 15

(56) References Cited

U.S. PATENT DOCUMENTS

| | | | | | |
|---|---|---|---|---|---|
| 343,298 | A | * | 6/1886 | Conn | 292/DIG. 15 |
| 453,930 | A | * | 6/1891 | Follette | |
| 1,081,634 | A | * | 12/1913 | Smith | |
| 1,704,967 | A | | 3/1929 | Fuller | |
| 1,711,626 | A | * | 5/1929 | Webster | 292/DIG. 15 |
| 1,787,147 | A | | 12/1930 | Dodge | |
| 2,037,404 | A | | 4/1936 | Utley | |
| 4,050,723 | A | | 9/1977 | Papadatos | |
| 5,269,573 | A | * | 12/1993 | Rear | 292/DIG. 15 |

FOREIGN PATENT DOCUMENTS

| | | |
|---|---|---|
| CH | 251329 | 7/1948 |
| DE | 375048 | 5/1923 |
| WO | WO 92/03630 | 3/1992 |

* cited by examiner

*Primary Examiner*—Anthony Knight
*Assistant Examiner*—Mark Williams
(74) *Attorney, Agent, or Firm*—Fredrikson & Byron, P.A.

(57) ABSTRACT

A device for restraining movement of a door which includes a housing, a foot and pedal pivotally mounted at least partially within the housing, and a first cog portion on the foot and a second cog portion on the pedal. The device is arranged such that the first and second cog portions are engaged whereby pivoting the pedal causes the entire foot to rotate between a non-restraint position where the foot is not in contact with the ground, and a restraint position where the foot is in contact with the ground.

13 Claims, 5 Drawing Sheets

DEVICE FOR RESTRAINING MOVEMENT OF A DOOR

BRIEF DESCRIPTION OF THE INVENTION

The present invention relates to a means of restraining the movement of a door.

FIELD OF THE INVENTION

A door can normally open and close freely. However, there are times when one does not wish a door to have this unrestrained movement. This may be to hold the door partially open, such as to let through a breeze, but not have the door slam shut. Also, one may wish to only partially open the door to see a visitor at the door. One may decide that one does not wish to open the door further, thus preventing the visitor from entering. This may even be in the face of an attempted forced entry through the door by the visitor. The present invention seeks to overcome at least some of the above mentioned problems.

SUMMARY OF THE PRESENT INVENTION

In accordance with a first aspect of the present invention there is provided a device for restraining movement of a door which includes:

a housing with means for affixing the housing to the door;

a foot pivotally mounted at least partially within the housing including a cog fixed to the foot, whereby the foot is arranged to rotate between a non-restraint position, where the foot is not in contact with the ground, and a restraint position, where the foot is in contact with the ground;

a pedal pivotally mounted at least partially within the housing, the pedal including a portion of a cog engaged with the cog of the foot;

the cog of the foot and the portion of the cog of the pedal forming a gear means, whereby pivoting of the pedal causes the foot to pivot between the non-restraint position and the restraint position, wherein when the foot is in the restraint position, contact of the foot with the ground provides resistance to movement of the foot with respect to the ground, thus restraining movement of the door.

BRIEF DESCRIPTION OF THE DRAWINGS

The present invention will now be described, by way of example, with reference to the accompanying drawings, in which.

DESCRIPTION OF THE INVENTION

Figure 1:
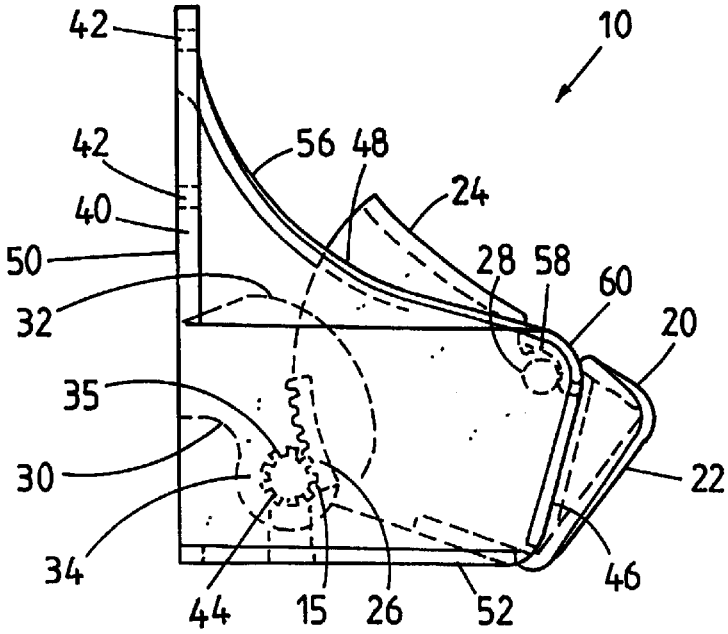
FIG. 1 is a side view of a first embodiment of a door movement restraining device of the present invention in a non-restraint mode.

Referring to FIGS. 1, 1*a*, 2 and 2*a* there is shown a door movement restraining device 10 which includes a housing 40, a foot 30, a pedal 20 or 20' and a gear means 15. Referring to FIGS. 3, 3*a*, 4 and 4*a* there is shown the pedal 20 or 20' which includes a front end 22, a top portion 24, a cavity 25, a pivot 28 located on both sides of the pedal 20 a plurality of portions of a cog, hereafter referred to as cog portions and indicated in the drawings by the number 26. The cog portions 26 have an axis of rotation at the pivot 28. One of each of the cog portions 26 is located on the first side and a second side of the cavity 25. The cavity 25 is defined at least in part by the top portion 24 and the front end 22.

Figure 3:
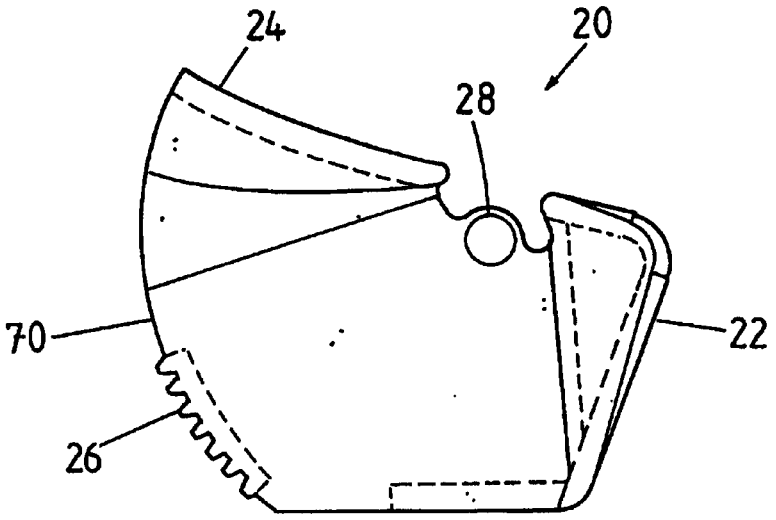
FIG. 3 is a side view of a first embodiment of a pedal of the door movement restraining device of FIG. 1.
Figure 3A:
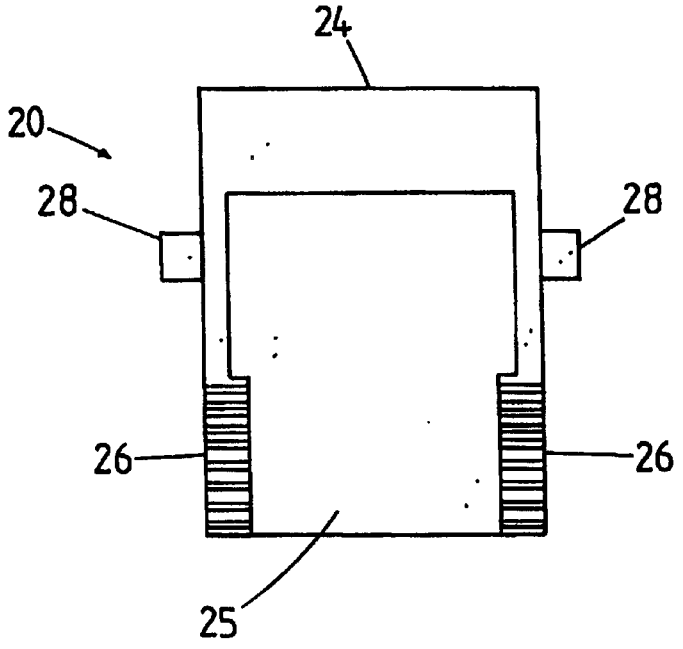
FIG. 3*a* is an end view of the pedal of the door movement restraining device of FIG. 3.

In FIGS. 3 and 3*a* a first embodiment of the pedal 20 is shown. The pedal 20 has a rear end 70 opposite the front end 22. The cog portions 26 are located on an exterior edge of the rear end 22 of the pedal 20.

Figure 4:
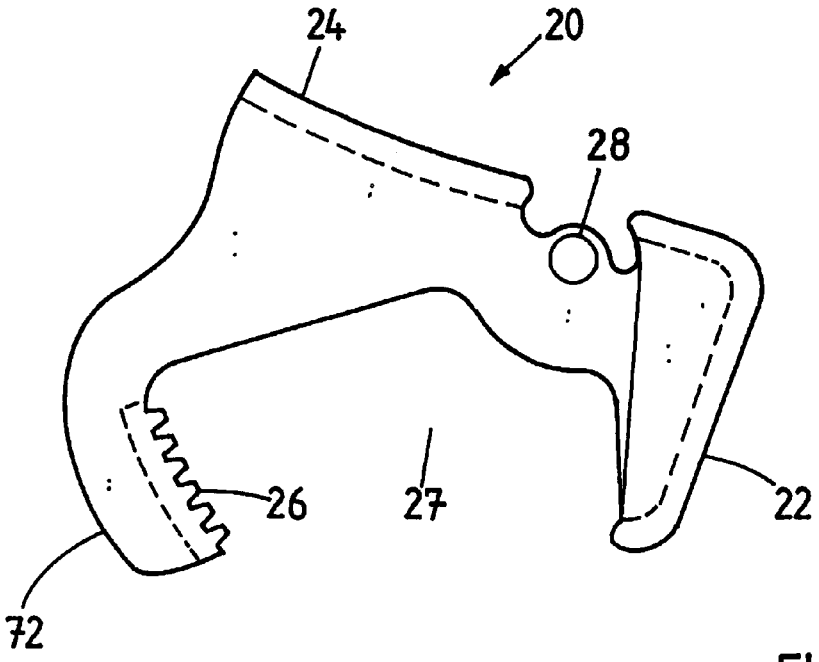
FIG. 4 is a side view of a second embodiment of a pedal of the door movement restraining device of FIG. 2.
Figure 4A:
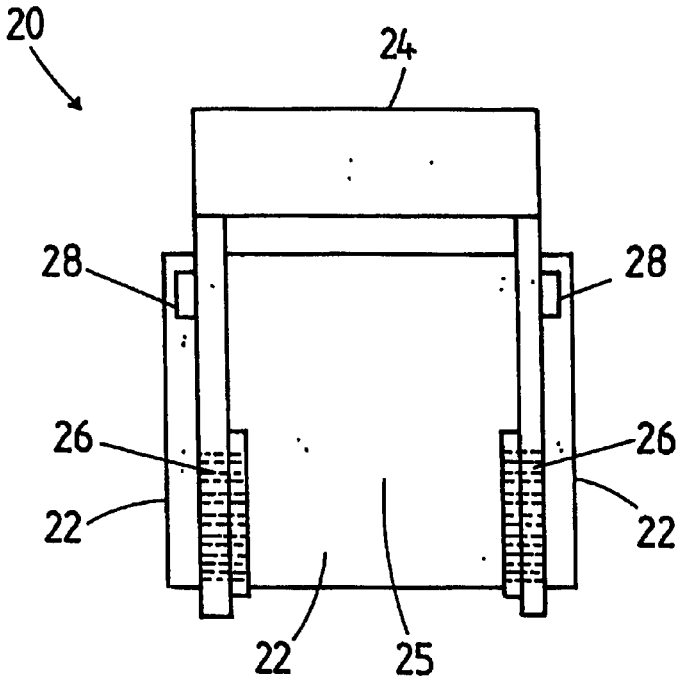
FIG. 4*a* is an end view of the pedal of the door movement restraining device of FIG. 4.
Figure 5:
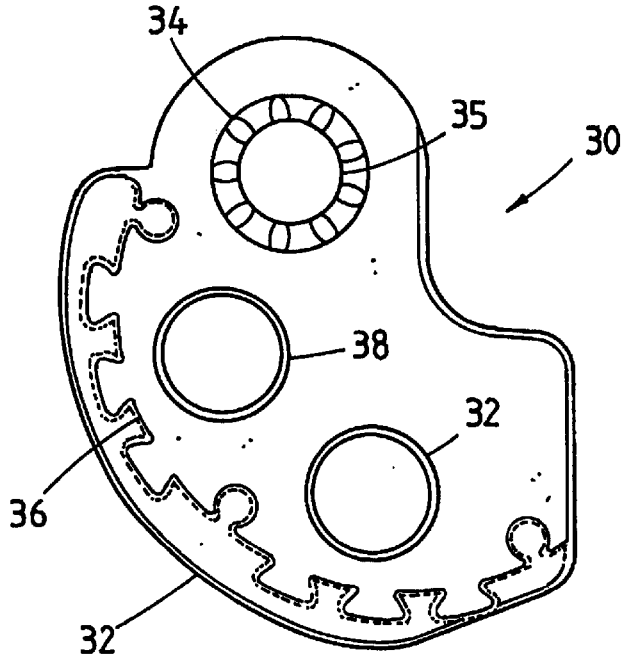
FIG. 5 is a side view of a foot of the door movement restraining device of FIGS. 1 and 2.

In FIGS. 4 and 4*a* a second embodiment of the pedal 20 is shown. The pedal 20 has a rear end 72 spaced from the front end 22. The cog portions 26 are located on an interior surface of a gap 27 formed between the front end 22 and the rear end 72 of the pedal 20'. Referring to FIG. 5, there is shown a foot 30 which includes a gripping surface 32, cogs 34, a pivot 35 located at the centre of each cog 34 and an attachment means 36 which attaches the gripping surface 32 to the foot 30. The cogs 34 are positioned on either side of the foot 30. Preferably, the foot 30 has at least one hollow 38 within which a counterweight may be inserted to provide bi-stable pivot positions of the foot 30.

Figure 6:
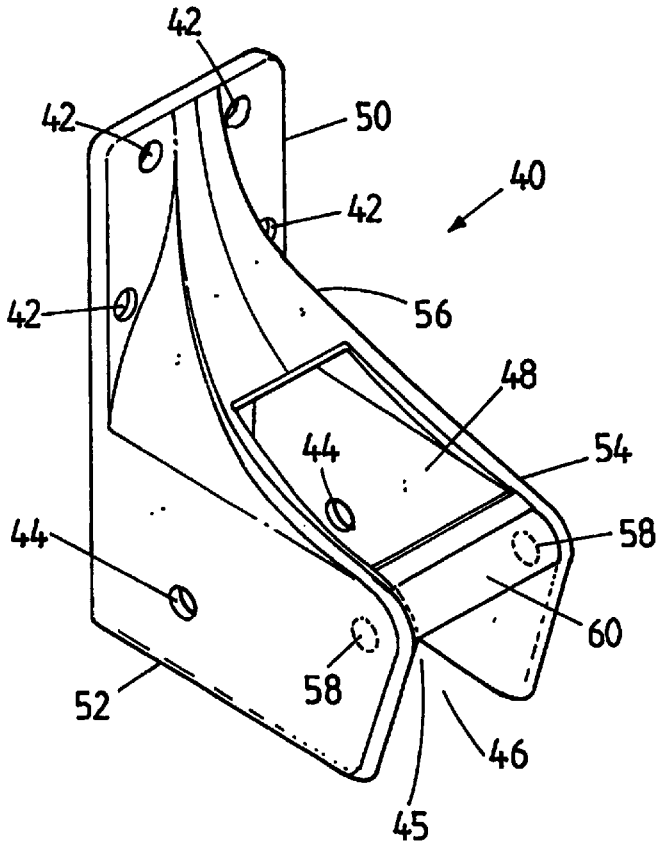
FIG. 6 is a perspective view of housing of the door movement restraining device of FIGS. 1 and 2.

Referring to FIG. 6, there is shown a housing 40 which includes locating holes 44 on either side of the housing 40 for the pivots 35, a hollow interior 45, a front opening 46, a top opening 48, side walls 52 and 54, locating holes 58 on the interior of each of the side walls 52 and 54 for the pivots 28, an upper surface 56, a strengthening member 60 and a back member 50 which includes attachment holes 42 for attaching the housing to a door.

Referring to all the Figures, the pedal 20 or 20' is located partially within the hollow interior 45 of the housing 40 and each pivot 28 is located within the locating holes 58. This allows the pedal 20 or 20' to pivot. The front end 22 of the pedal 20 or 20' protrudes out of the front opening 46 and the top portion 24 of the pedal 20 or 20' protrudes out of the top opening 48. When the pedal 20 or 20' pivots, the front end 22 or the top portion 24 protrude further or less out of the openings 46 or 48 respectively, depending on the direction of the pivoting motion, such that when one is depressed the other protrudes further out of the housing 40 and the pedal 20 or 20' pivots in one direction. When the other is depressed the reverse occurs. Pivoting of the pedal 20 or 20' causes rotation of the cog portions 26 about their axis of rotation.

The device 10 has two modes of operation. The first mode is a non-restraint mode, which is the normal state of the device 10, and a restraint mode. The foot 30 is arranged to be in a non-restraint position when the device 10 is in the non-restraint mode and in a restraint position when the device 10 is in the restraint mode.

In the non-restraint position, the foot 30 is located in the hollow interior 45 of the housing 40 and also within a portion of the cavity 25 of the pedal 20 or 20'. In the restraint position, the foot 30 is located partially in the hollow interior 45, partially in the cavity 25 and projects downwardly partially from the housing 40.

The pivots 35 engage with the locating holes 44 on either side of the housing 40. Each of the cogs 34 of the foot 30 engages with one of the cog portions 26 of the pedal 20 or 20' forming the gear means 15.

Figure 1A:
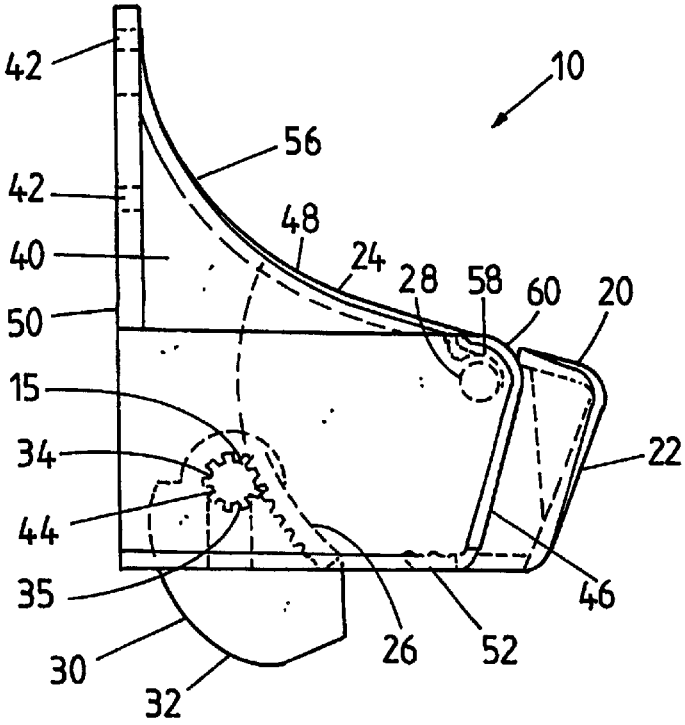
FIG. 1*a* is a side view of the door movement restraining device of FIG. 1 in a restraint mode.

In the first embodiment of the present invention, the gear means 15 is arranged such that when the top portion 24 of the pedal 20 is pushed down the gear means 15 causes the foot 30 to rotate from the non-restraint position, shown in FIG. 1, to the restraint position shown in FIG. 1*a*. When a force is applied to the front end 22 of the pedal 20, the gear means 15 causes the foot 30 to rotate from the restraint position to the non-restraint position.

Figure 2:
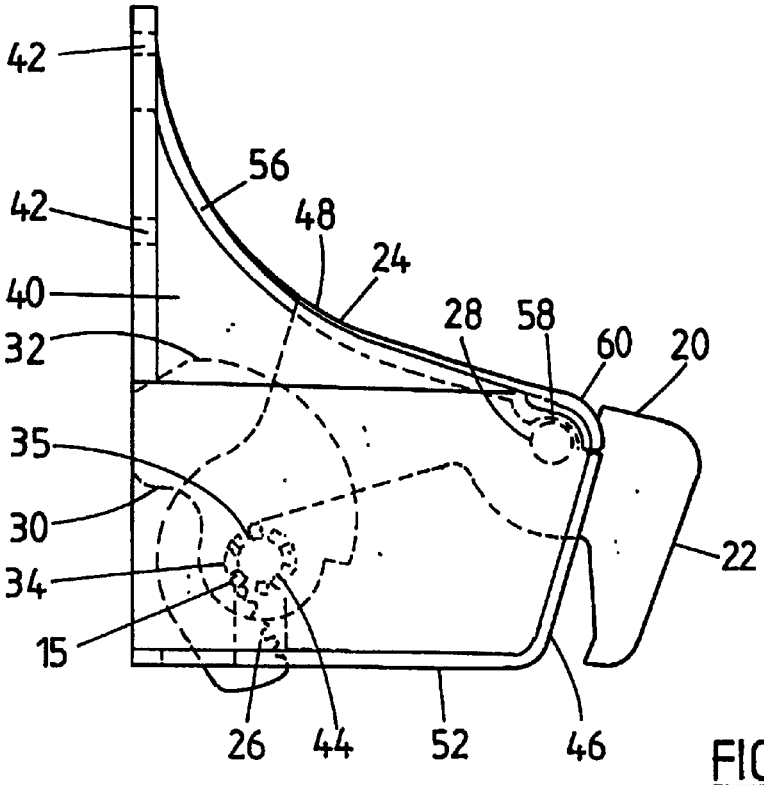
FIG. 2 is a side view of a second embodiment of a door movement restraining device of the present invention in a non-restraint mode.
Figure 2A:
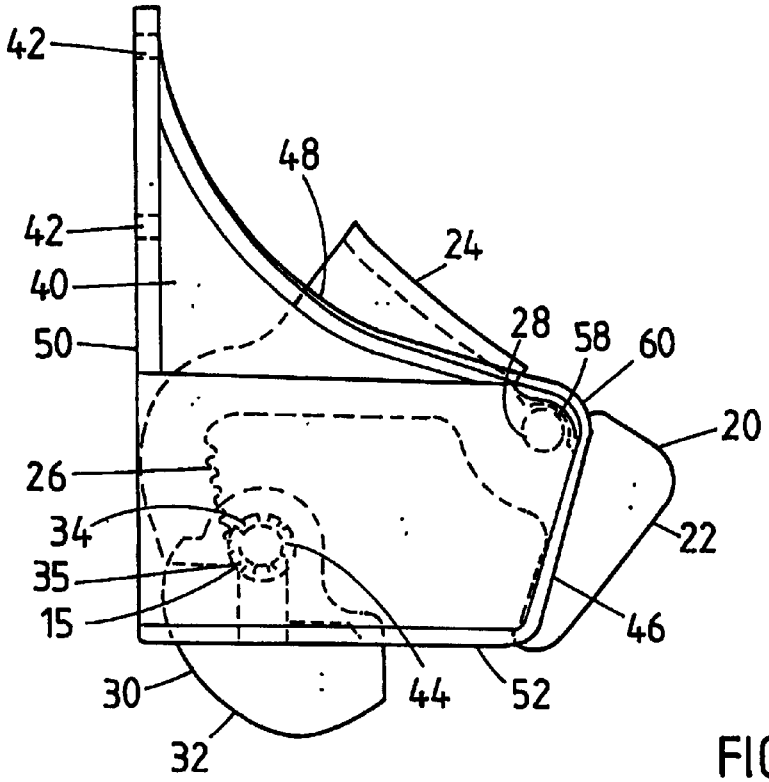
FIG. 2*a* is a side view of the door movement restraining device of FIG. 2 in a restraint mode.

In the second embodiment of the present invention, the gear means 15 is arranged such that when the front end 22 of the pedal 20' is pushed in, the gear means 15 causes the foot 30 to rotate from the non-restraint position, shown in FIG. 2, to the restraint position shown in FIG. 2*a*. When a force is applied to the top portion 24 of the pedal 20', the gear means 15 causes the foot 30 to rotate from the restraint position to the non-restraint position.

The gripping surface 32 of the foot 30 contacts with the ground when the foot is in restraint mode. The gripping surface 32 provides friction and thus prevents the device 10 from moving with respect to the ground and thus the door opening or closing.

The attachment means 42 may be holes so that the back member 50 may be abutted to the door and thus fixed in place by a suitable means such as screws.

Referring to the Figures, the manner of use and operation of the apparatus of the present invention will now be described.

The back member 50 of the housing 40 is abutted to the base of the door and positioned at a suitable height above the ground. The device 10 is then attached to the door using screws through the holes 42. The door movement restraining device 10 is now ready for use.

In use, the device 10 begins in non-restraint mode shown in FIG. 1 or FIG. 2. The door may be partially opened then the pedal 20 or 20' may be depressed, on the top portion 24 in the first embodiment and at the front end 22 in the second embodiment, thus causing the device 10 to change to restraint mode as shown in FIG. 1*a* or FIG. 2*a*.

The foot 30 rotates from the non-restraint position to the restraint position and contacts with the ground. The gripping surface 32 of the foot 30 provides friction with the ground restraining the device 10 and thus the door from movement.

To release the device 10 from restraint mode, the front end 22 in the first embodiment or the top portion 24 in the second embodiment, is depressed causing the foot 30 to rotate from the restraint position to the non-restraint position. The gripping surface 32 of the foot 30 breaks contact with the ground while rotating up into the housing 40 and thus allows the door to be freely opened or closed.

Modifications and variations such as would be apparent to a skilled addressee are deemed within the scope of the present invention.

What is claimed is:

1. A device for restraining movement of a door comprising:

a. a housing with means for affixing the housing to the door;

b. a foot pivotally mounted at least partially within the housing for rotational movement between a non-restraint position wherein the foot is not in contact with the ground, and a restraint position wherein the foot is in contact with ground thereby restraining movement of the door;

c. a first cog portion on the foot;

d. a pedal pivotally mounted at least partially within the housing, the pedal including a front end, a top portion and a second cog portion arranged to engage with the first cog portion on the foot; and wherein the first cog portion on the foot and the second cog portion on the pedal form a gear means such that when a force is applied to the top portion of the pedal the entire foot rotates in a first direction and when a force is applied to the front end of the pedal the entire foot rotates in a second direction opposite the first direction.

2. A device according to claim 1, wherein the pedal includes a pivot located on a first side of the pedal and a second side of the pedal, the first side being opposite the second side, and a cavity defined by the front end, the top portion, and the first side and second side of the pedal.

3. A device according to claim 2 wherein the front end of the pedal protrudes through a front opening of the housing and the top portion of the pedal protrudes through a top opening of the housing.

4. A device as in any one of claims 2–3 wherein the foot is at least partially located in the cavity of the pedal when the foot is in the non-restraint position.

5. A device according to claim 1, wherein the pedal is configured to have a rear end substantially opposite the front end, and the second cog portion is located on an exterior edge of the rear end.

6. A device according to claim 1, wherein the pedal is configured to have a rear end spaced from the front end, whereby a gap is formed between the front end and the rear end and the second cog portion is located on an interior surface of the gap.

7. A device according to claim 5, wherein the gear means is arranged such that when downward force is applied to the top portion of the pedal, the gear means causes the foot to rotate from the non-restraint position to the restraint position and when horizontal force is applied to the front end of the pedal the gear means causes the foot to rotate from the restraint position to the non-restraint position.

8. A device according to claim 6, wherein the gear means is arranged such that when horizontal force is applied to the front end of the pedal, the gear means causes the foot to rotate from the non-restraint position to the restraint position and when downward force is applied to the top portion of the pedal the gear means is arranged to cause the foot to rotate from the restraint position to the non-restraint position.

9. A device according to claim 1, wherein the foot includes a gripping surface.

10. A device according to claim 1, wherein the foot includes a pivot point located at the center of the first cog portion of the foot.

11. A device according to claim 1, wherein the foot has at least one cavity for holding a weight.

12. A device according to claim 3, wherein a generally downward force applied to the top portion of the pedal causes the foot to rotate in the first direction and a generally horizontal force applied to the front end of the pedal causes the foot to rotate in the second direction.

13. A device according to claim 2, wherein the second cog portion on the pedal has an axis of rotation centered at the pivot of the pedal.

* * * * *